United States Patent [19]

Dietch et al.

[11] Patent Number: 4,593,225

[45] Date of Patent: Jun. 3, 1986

[54] TENSION MASK COLAR CATHODE RAY TUBE

[75] Inventors: Leonard Dietch, Skokie; Kazimir Palac, Carpentersville, both of Ill.

[73] Assignee: Zenith Electronics Corporation, Glenview, Ill.

[21] Appl. No.: 646,862

[22] Filed: Aug. 31, 1984

[51] Int. Cl.[4] ..... H01J 29/81; H01J 29/07

[52] U.S. Cl. ..... 313/407; 313/402; 313/477 R; 220/2.1 A

[58] Field of Search ..... 313/402, 407, 269, 283, 313/284, 292, 477 R, 482, 348, 349, 258; 220/2.1 A

[56] References Cited

U.S. PATENT DOCUMENTS

| | | | |
|---|---|---|---|
| 2,625,734 | 1/1953 | Law | 445/4 |
| 2,813,213 | 11/1957 | Cramer et al. | 313/78 |
| 2,842,696 | 7/1958 | Fischer-Colbrie | 313/78 |
| 2,905,845 | 9/1959 | Vincent | 313/78 |
| 3,284,655 | 11/1966 | Oess | 313/482 |
| 3,489,966 | 1/1970 | Bradu et al. | 313/83 |
| 3,638,063 | 1/1972 | Tachikawa et al. | 313/348 |
| 3,719,848 | 3/1973 | Bradu | 313/402 |
| 3,894,321 | 7/1975 | Moore | 445/30 |
| 3,898,508 | 8/1975 | Pappadis | 313/405 |
| 4,069,567 | 1/1978 | Schwartz | 445/50 |
| 4,100,451 | 7/1978 | Palac | 313/404 |

FOREIGN PATENT DOCUMENTS

| | | | |
|---|---|---|---|
| 2315353 | 3/1973 | Fed. Rep. of Germany | 313/407 |
| 0086049 | 6/1980 | Japan | 313/407 |
| 014148 | 11/1981 | Japan | 313/482 |
| 1163495 | 6/1966 | United Kingdom . | |

*Primary Examiner*—David K. Moore
*Assistant Examiner*—M. Razavi
*Attorney, Agent, or Firm*—John H. Coult; Cornelius J. O'Connor; Ralph E. Clarke, Jr.

[57] ABSTRACT

A tension mask color cathode ray tube comprises an envelope funnel having a central axis and including a bell portion, one extremity of which has a sealing land. A flat or cylindrical face panel has a target adapted to receive a pattern of luminescent primary color elemental phosphor areas, with a sealing land circumscribing the target. A color selection electrode structure sealed between the sealing lands of the funnel and panel constitutes an integral part of the tube envelope. The electrode structure has a central opening dimensioned to enclose the panel target, and includes a frame supporting a tensed foil color selection electrode. The frame has a support surface fixedly receiving and maintaining the electrode in tension. The frame further has an axial dimension which establishes the color selection electrode at a predetermined Q-distance from the target on the face panel.

1 Claim, 2 Drawing Figures

TENSION MASK COLAR CATHODE RAY TUBE

CROSS REFERENCE TO RELATED APPLICATIONS

This application is related to but in no way dependent upon copending applications Ser. Nos. 538,001 and 538,003 both filed Sept. 30, 1983; Ser. Nos. 572,088 and 572,089 both filed Jan. 18, 1984; and Ser. No. 646,861 filed Aug. 31, 1984; all of common ownership herewith.

BACKGROUND OF THE INVENTION

This invention relates in general to flat-panel color cathode ray tubes, and to an improved unitary structure between the funnel and face panel of such a tube for supporting a tensed color selection electrode.

In general, a color selection electrode or "shadow mask" is a device which is disposed adjacent the luminescent phosphor screen, that forms the target electrode of a color cathode ray tube, to control the landing pattern of one or more electron beams as they are swept across the screen. The shadow mask achieves color selection by partially shadowing the surface of the screen from scanning electron beams, permitting access to selected elemental phosphor areas only by appropriately assigned beams. The choice of a color selection electrode for use in color television cathode ray tubes is, by and large, a choice between a spherical or bi-radial electrode and a cylindrical electrode tensed upon a heavy spring frame--both types being supported within the tube envelope. The most common type of color selection electrode used in color television receivers today is the untensed type.

In color picture tubes utilizing a conventional shadow mask, there is a tendency on the part of the mask to "dome" (localized buckling) in those areas where a scene characterized by very high brightness is depicted. For example, in a scene where a high concentration of light is presented for an extended period of time, when the beams sweep that area of the screen the current in each beam peaks precipitously with an attendant localized heating of the mask. As a result of such a concentration of heat, that area of the mask expands and displaces itself from its original "cold" position to a position in which it does not effect proper masking of the writing electron beams. As a result, color purity is degraded. Moreover, because of its vulnerability to "doming", a conventional mask cannot accommodate the power density that a "doming-resistant" tensed mask can.

The general practice in cathode ray tubes manufactured for use in color television receivers is to position the mask at an assigned location, relative to the phosphor screen, by suspending it from three preselected points disposed about the periphery of the tube's face panel. This suspension accommodates overall thermal expansion of the mask by causing the mask to be displaced toward the screen from its original position by provision of bi-metallic support springs; however, such provision can not resolve the above-described localized "doming" problem caused by concentrated heating in localized areas of the mask.

Insofar as the use of a tensioned color selection electrode is concerned, the most common use of such an electrode has been in connection with the cylindrical faceplate CRT produced by one color television manufacturer. In that tube, the color selection electrode comprises a grid formed of a multitude of parallel conductors tensed across a spring frame suspended conventionally within the tube. This grid serves to mask the writing beams in such a fashion that they fall upon the desired light emitting phosphor.

In the afore-mentioned cylindrical faceplate tube, the mask supporting frame is mechanically stressed, as by compressing it, prior to attaching the shadow mask thereto. Upon release of the compression force, restoration forces in the frame establish tension in the mask. However, because of the tension in these tautly stretched conductors, provision must be made to prevent, or counter, any mechanically or thermally induced vibration of the conductors, which vibration, of course, would severely degrade a reproduced image.

An advantage of utilizing a tensed mask resides in the fact that the mask, while under tension, will not "dome" as readily as an untensed mask. A tensed mask retains its desired configuration during normal operating conditions, under bombardment to "relax" enough to negate the pre-established expansion of the mask. A cathode ray tube utilizing a tensed grid mask of the type adverted to above is described in U.S. Pat. No. 3,638,063.

The color television cathode ray tube in most common usage today employs a faceplate which approximates a section of a large radius sphere. The shadow mask in such a tube, of course, is contoured to match the faceplate. A trend today is toward a flatter faceplate which, in turn, calls for a flatter shadow mask. However, a flat mask is inherently less mechanically stable than a curved mask. Accordingly, to acquire stability, resort is had to a thicker mask, for example, one having a thickness in the order of 10 to 12 mils. This is approximately twice the thickness of a conventional curved mask. However, when one goes to a 10 to 12 mil mask the aperture etching process is much more difficult. Specifically, in order to prevent aperture limiting of the beam at the outer reaches of the mask, as would be encountered in a 90 degree tube, the apertures have to be etched at an angle to the plane of the mask, rather than etched substantially perepndicular to that plane as is the case for a conventional curved mask.

DISCUSSION OF THE PRIOR ART

An early example of tensed shadow mask for use in a color television cathode ray tube is described in U.S. Pat. No. 2,625,734. The tensed mask described therein was created by resort to a process called "hot-blocking". The practice was to insert a flat mask between a pair of frames which loosely received the mask. A series of tapped screws joining the two frames served to captivate the mask when the screws were subsequently drawn-down. The loosely assembled frame and mask was then subjected to a heat cycle by positioning heated platens adjacent the mask to heat and thereby expand it. The frame, however, was kept at room temperature. When the mask attained a desired expansion, the frame screws were tightened to captivate the mask in its expanded state. The heating platens were then removed. Upon cooling down to room temperature, the mask was maintained under tension by the frame. The resultant assembly was then mounted inside the tube adjacent the phosphor screen.

U.S. Pat. No. 3,284,655—Oess is concerned with a direct viewing storage cathode ray tube employing a mesh storage target which is supported in a plane perpendicular to the axis of the tube. The mesh target comprises a storage surface capable of retaining a charge pattern which, in turn, controls the passage therethrough of a stream of electrons. From a structural standpoint, it is proposed that the mesh storage screen be affixed (no details given) to a circumferential ring that is disposed across the open end of an envelope section of the tube. One end of the ring is in contact with an edge of that envelope section which has a coating of glass frit applied thereon. The end wall of another envelope section, also coated with frit, is placed in contact with the other side of the ring so that the end walls of the envelope sections now abut both sides of the ring. Thereafter this assembly is frit sealed to secure the ring and mesh target within the tube.

It is of particular significance that the electrode spanning the inside of the tube envelope is a mesh screen that is not said to be subject to tension forces. Moreover, the mesh screen is not a color selection electrode that serves to direct a writing beam to selected elemental areas of color phosphors. Finally, there is no criticality, perceived or discussed, as respects mesh target registration with the phosphor layer on the faceplate.

British Pat. No. 1,163,495 describes the use of a flat apertured metal mask which is sealed between the face of the tube and its cone. The periphery of the mask is multilated to provide a plurality of outwardly directed narrow tabs (0.2 to 0.5 mm wide) which, when sealed to the bulb wall provide the sole support for the mask. By way of introducing background, the patent decries the industry practice of "tailor-making" the luminescent screen by "marrying" a mask to the screen it was employed to make. It is suggested that such "tailoring" be avoided by making the mask and screen ". . . . separately with the utmost precision." This comment is followed by the naive (and unsupported) thesis that a flat screen made with great precision and a flat highly accurate mask, independent of the screen making, are utilizable in color CRT manufacturing. In any event, it is the thrust of the patent that the tabs serve as tension exerting springs to maintain the mask flat. The disclosure is silent as to how registration between this flat mask and the luminescent screen is to be achieved.

U.S. Pat. No. 2,813,213 describes a cathode ray tube which employs a switching grid mounted adjacent the phosphor screen to provide a post deflection beam deflecting force. Basically, it is proposed to employ a taut wire grid that is sealed in the tube envelope wall and which, in one embodiment, proposes the use of an external frame to relieve the tension forces applied by the taut grid to the glass wall of the tube. In another embodiment, which is not pictorially disclosed but simply textually referred to, an arrangement is proposed comprising a glass donut-shaped structure into which the grid wires are sealed. This donut assembly is then inserted between the faceplate of the tube and its conical section. Thereafter, the patent notes, after the tube is assembled, the phosphors may be deposited on the faceplate by conventional photographic processes. The application of elemental color phosphor areas to the faceplate of a tube is, in itself, a formidable task; how this could be achieved with a grid structure in situ across the faceplate is not only not addressed but seems to be dismissed in rather cavalier fashion.

U.S. Pat. No. 3,894,321, of common ownership herewith, is directed to a method for processing a color cathode ray tube having a thin foil mask sealed directly to the bulb. Included in this disclosure is a description of the sealing of a foil mask between the juncture of the skirt of the faceplate and the funnel. The foil mask is noted as having a greater thermal coefficient of expansion than the glass to which it is mounted, hence following a heating and cooling cycle in which the mask is cemented at the funnel-faceplate juncture, the greater shrinkage of the mask upon cooling places it under tension. The mask is shown as having two or more alignment holes near the corners of the mask which mate with alignment nipples in the faceplate. The nipples pass through the alignment holes to fit into recesses in the funnel. In another embodiment, the front panel is shown as having an inner ledge forming a continuous path around the tube, the top surface of which is a Q-distance away from the faceplate for receiving the foil mask such that the mask is sealed within the tube envelope. An embodiment is also shown in which the faceplate is skirtless and essentially flat.

In U.S. Pat. No. 4,069,567, assigned to the assignee of the present invention, there is disclosed a method useful in the manufacture of a color cathode ray tube of the type having a phosphor screen and spaced therefrom a tensed color selection electrode. The method is a method of installing the electrode such that under normal tube operating conditions, the electrode is held by a holder in a hypertensed state and is thus capable of withstanding an unusually high electron beam bombardment before relaxing. In a preferred execution, the method comprises selecting for the electrode a material which has a significantly higher coefficient of thermal expansion than that of the holder. The electrode and the holder are externally heated together as by an oven while the electrode is tensed. Simultaneously therewith, a selective auxiliary heating of the electrode is expected, as by passing an electrical current through the electrode, or by RF heating, such that the holder is heated to a predetermined second elevated temperature significantly greater than the first temperature, the holder and electrode thus being caused to thermally expand, but the electrode by a greater amount. The electrode is affixed to the holder. Finally, the electrode and holder are cooled to room temperature so as to hypertense the electrode due to the greater coefficient of thermal expansion and temperature fall of the electrode than the holder.

U.S. Pat. No. 4,100,451 to Palac, which is assigned to the assignee of the present invention, describes a system for suspending a non-self-rigid shadow mask a predetermined distance from a faceplate. Four suspension means provide for coupling and indexing the mask directly to corner portions of the faceplate. In one embodiment, the indexing means comprise legs having rounded portions which engage indexing cavities in the faceplate which may be in the form of V-grooves or slots. Another approach shows V-blocks at the four corners of the faceplate, each of which receives a clamp attached to the mask. Each clamp has a foot for mating with the V-block. The suspension and indexing means provide for the permanent mounting of the shadow mask in relation to the faceplate, as well as for the temporary mounting of the mask during the production screening process.

Other examples of the prior art practice of utilizing a tensioned grid-type structure in a cathode ray tube environment are described in the following U.S. Pat. Nos. 2,761,990; 2,842,696, 2,905,845, 3,440,469, 3,489,966, 3,683,063 and 3,719,848, 3,873,874, and 4,495,473.

On the other hand, a color cathode ray tube employing a tensed foil type shadow mask is described and claimed in referent co-pending application Ser. No.

538,003 filed Sept. 30, 1983 in the name of Kazimir Palac. Additionally, a color cathode ray tube employing a planar foil type mask in conjunction with a flat faceplate is described and claimed in referent co-pending application Ser. No. 538,001, also filed on Sept. 30, 1983 in the name of Kazimir Palac.

Finally, and by way of emphasizing the extent to which the invention to be described departs from the prior art, attention is directed to U.S. Pat. No. 3,898,508 which shows and describes a faceplate and shadow mask (untensed) assembly representative of current practice.

OBJECTS OF THE INVENTION

Accordingly, it is a general object of the invention to provide an improved structure for supporting a tensed color selection electrode in a color cathode ray tube.

It is a specific object of the invention to provide a tensed shadow mask unitary support structure insertable as a tube constituent between a flat face panel and the funnel of a color cathode ray tube.

It is still another object of the invention to provide a planar tensed mask and support structure which is readily photoscreened.

It is also an object of the invention to provide a color television cathode ray tube which, in adopting the improved tensed mask unitary support structure, offers significant economic and performance advantages over prior art tubes.

DESCRIPTION OF A PREFERRED EMBODIMENT

Figure 1:
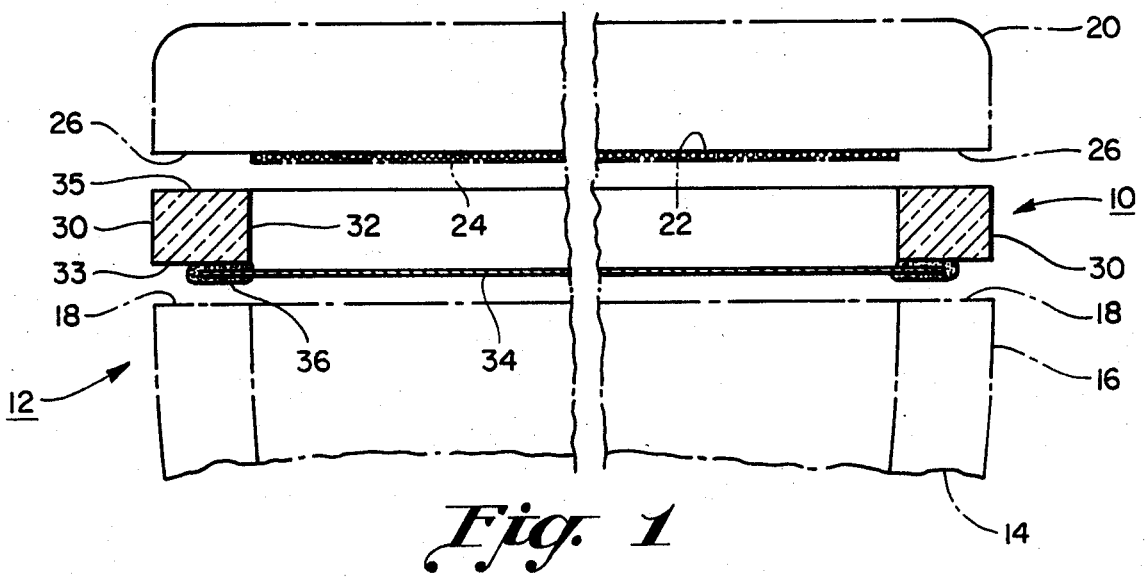
FIG. 1 is an exploded sectioned view of a portion of a color cathode ray tube embodying a constituent structure for supporting a tensed color selection mask.

An improvement, comprising a unitary color selection electrode structure 10, for use in a tension mask color cathode ray tube 12 is highlighted in FIG. 1. Tube 12 comprises an envelope funnel 14 (only partially illustrated) having a central axis and including a bell portion 16. The depicted extremity of bell portion 16 has a predetermined wall thickness and it comprises a sealing land 18. The funnel is formed of a material having a predetermined temperature coefficient of expansion.

Additionally, tube 12 comprises a flat, substantially rectangular, glass face panel 20 formed of a material having a like predetermined temperature coefficient of expansion. Panel 20 comprises a target area 22 having a patterned screen 24 of luminescent primary color elemental phosphor areas deposited thereon, which deposits may be arranged in triads of red, green, and blue phosphor dots. Alternatively, the screen may adopt the line screen format in which the phosphor deposits are formed as stripes, rather than dots. In any event, a sealing land 26 circumscribes target area 22.

Figure 2:
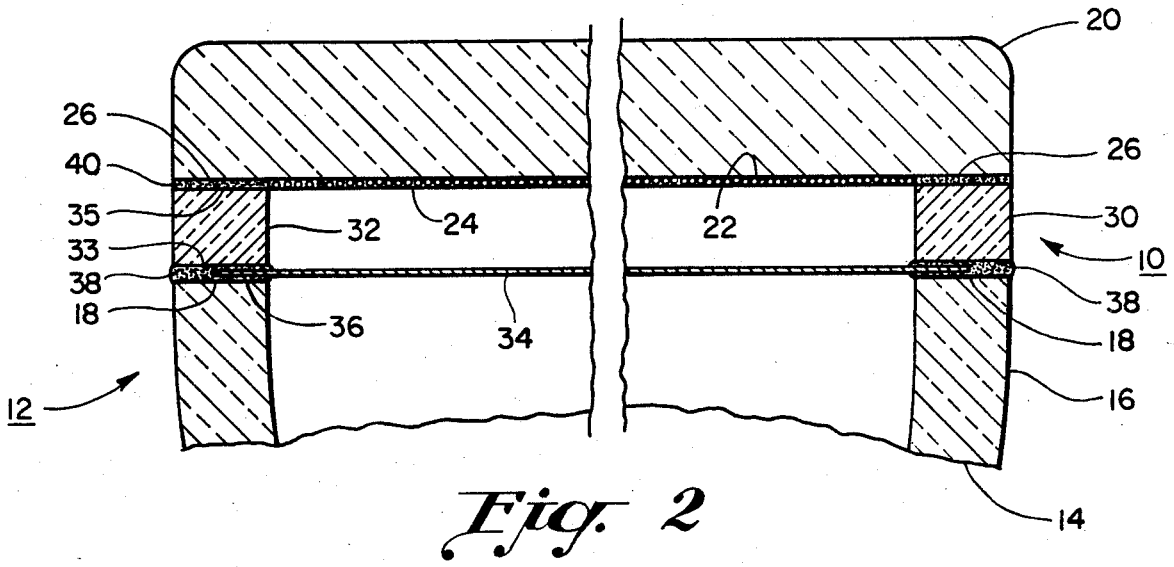
FIG. 2 is a sectioned view of a color cathode ray tube showing a preferred embodiment of the mask supporting structure in FIG. 1.

The constituent structure 10 shown in FIG. 1 is insertable between funnel sealing land 18 and panel sealing land 26 and, as depicted in FIG. 2, is frit sealable therebetween to constitute an outer wall of tube 12. Structure 10 permits selective excitation of the phosphor deposits by a scanning beam of electrons and, to that end, is centrally apertured to afford such a beam access to phosphor screen 24.

Unitary structure 10 comprises a frame 30 formed of a material, such as glass or ceramic, having a temperature coefficient of expansion approximating that of panel 20. The frame has a substantially rectangular outer contour which is spatially coextensive with the contour of the immediately adjacent portion of bell section 16 of the envelope funnel and, of course, coextensive with the contour of the face panel 20. Frame 30 is characterized by a substantially rectangular central opening, or window 32, dimensioned to enclose panel target 22. To this end, frame 30 can adopt the form of a section of a rectangular cylinder.

Frame 30 has a flat support surface 33 which is adapted to fixedly receive, and maintain in tension, a color selection electrode in the form of a tensed planar foil 34 having a predetermined pattern of apertures which, in one execution of the invention, can be triads of minute circular holes. In any event, whatever execution is selected, the aperture pattern, of course, would correspond to the pattern of phosphor deposits forming screen 24 on face panel target area 22. Foil 34 has a temperature coefficient of expansion which is greater than that of frame 30. Thus, foil 34 can be formed from cold rolled steel when frame 30 is formed from glass. In a fashion to be explained, the peripheral portion of foil 34 is bonded to the surface of support 33 by a bead of frit, a devitrifying glass adhesive employed in fabricating cathode ray tubes. As shown, the peripheral portion of the foil overlies less than all of surface 33. Desirably, after being secured to support surface 33, the foil's overall reach is about half way across surface 33. Isolation of high voltage conventionally applied to such electrodes is hereby provided. As will be seen, support surface 33 also constitutes a sealing land for bonding structure 10 to sealing land 18 of the funnel bell 16.

As shown in the drawings, in addition to its foil supporting function, surface 33 also constitutes the sealing land that confronts sealing land 18 of bell portion 16 of the envelope funnel. For purposes made clear below, frame 30 includes an additional sealing land 35. As depicted, the outer peripheral portion of frame 30, immediately adjacent funnel sealing land 18, is spatially coextensive with the contiguous section of the funnel's bell portion 16. In this regard, it is desirable that the transverse wall thickness of frame 30 substantially match the wall thickness of the aforesaid contiguous section of the bell. However, it is important that the transverse dimension of the frame wall be sufficient to accommodate the forces instilled in the frame by the tensed foil. The outer peripheral portion of frame 30 adjacent panel sealing land 26 has a substantially rectangular contour so that it matches and is spatially coextensive with the peripheral boundary of panel 20.

Frame 30 has an axial dimension which is a determinative in establishing foil 34 at a predetermined Q distance from target area 22 on face panel 20. More particularly the axial thickness of frame 30 is principally determinative of the aforesaid Q distance.

As shown, frame 30 comprises the pair of flat, spaced-apart, parallel surfaces 33, 35 which constitute sealing lands. Surface 35 confronts sealing land 26 of face panel 20 while surface 33 registers with the sealing land 18 of funnel bell 16. Thus when frame 30 is interposed between panel 20 and funnel bell 16, the spacing between sealing lands 33, 35, in other words the thickness of frame 30, in conjunction with the contribution from the aforementioned registration arrangement means, serves to establish foil 34 at the prescribed Q distance from target area 22.

The manner in which unitary structure 10 is fabricated for subsequent incorporation into a color cathode ray tube, as shown in FIG. 2, will now be described. A sheet of foil 34, having a length and breadth sufficient to completely overlay support surface 33 of frame member 30, is attached to a metal mount. Thereafter an application of a glass sealable metal alloy, or frit 36, is deposited on the inner half, approximately, of surface 33 of frame 30.

Then, the frame member and foil are securely clamped together and subjected to an elevated temperature which establishes the foil in tension and devitrifies the frit material so that the foil is permanently secured, in tension, to frame member 30. Thereafter, the foil material extending beyond the now devitrified frit 36 is removed.

The unitary structure 10, now comprising a bonded package of frame member 30 and a tensed planar foil 34, is utilized to develop a luminescent phosphor screen 24 on target surface 22 of the face panel. This tensed electrode assembly 10 is seated upon face panel 20 by the registration arrangement shown and described by Palac. Alternatively, the registration arrangement shown and described by Strauss in referent application Ser. No. 571,088 could be resorted to. A series of slurry coatings are applied to the face panel, sequentially, and individually exposed by a source of actinic light and washed to affix primary color phosphor deposits to the target of panel 20.

After the screening process has been completed, frit application 38, 40 are applied to respective sealing lands 33 and 35 of frame 30, see FIG. 2. Alternatively, the frit material could be applied to the sealing lands that register with the aforesaid lands, that is, the frit may be applied to sealing land 18 of the funnel bell portion and to sealing land 26 of the face panel 20. In any event, after the frit applications the tensed foil structure 10 is registered between face panel 20 and funnel and bell portion 16 of the funnel. This assembly is then inserted into a heat chamber the temperature of which is elevated to approximately 430 degree centigrade and maintained thereat for the requisite time period. After the frit has devitrified, unitary structure 10 will be captured between face panel 20 and bell portion 16 of the funnel to form an integral part of cathode ray tube 12. Thereafter, when the assemblage cools to room temperature and all materials have returned to their normal dimensions, foil 34 will remain tensed by virtue of its bonding to frame member 30 while structure 10 itself will remain permanently bonded between panel 20 and the funnel with tensed foil 34 in registration with luminescent screen 24.

The inventive teaching is applicable, with but minor departures from the disclosed structure, to a cathode ray tube employing a face panel that comprises a section of a cylinder, with the minor axis of that face panel being disposed parallel to an axis traversing the geometric center of rotation of such a cylinder. In such an embodiment, is it appreciated that the color selection electrode, or foil, would adopt the configuration of a curvilinear plane conforming to the geometry of the cylindrical face panel.

While a particular embodiment of the invention has been described, it will be obvious to those skilled in the art that changes and modifications may be made without departing from the invention in its broader aspects, and, therefore, the aim of the appended claims is to cover all such changes and modifications as fall within the true spirit and scope of the invention.

I claim:

1. A tension mask color cathode ray tube comprising:

an envelope funnel having a central axis and including a bell portion, one extremity of which has a sealing land;

a flat face panel formed of a material having a predetermined temperature coefficient of expansion and comprising a target surface having a pattern of luminescent primary color elemental phosphor areas deposited thereon and a sealing land circumscribing said target surface; and a color selection electrode structure permitting selective excitation of said phosphor areas by a scanning beam of electrons, comprising:

a planar tensed foil formed of a material having a temperature coefficient of expansion greater than that of said panel and having a predetermined pattern of apertures;

an insulating frame defining a central opening dimensioned to enclose said target surface of said face panel and formed of a material having a temperature coefficient of expansion approximating that of said face panel, the frame being substantially spatially coextensive with said sealing land on said face panel and with said funnel bell sealing land, said frame having a radially extending support surface facing away from said target surface and fixedly receiving said foil in tension, said foil overlying a radially inward portion but not a radially outward portion of said support surface such that said foil does not extend to the outer surface of said tube, thereby providing isolation of high voltage applied to the foil, said frame being sealed between said funnel sealing land and said panel sealing land to constitute an integral part of the tube envelope, said frame further having an axial dimension between said foil surface and an opposed face panel sealing surface which establishes said foil at a predetermined Q distance from said target surface.

* * * * *

Disclaimer 4,593,225.—*Leonard Dietch,* Skokie and *Kazimir Palac,* Carpentersville, Ill. TENSION MASK COLOR CATHODE RAY TUBE. Patent dated June 3, 1986. Disclaimer filed Nov. 24, 1986, by the assignee, *Zenith Electronics Corp.*

Hereby enters this disclaimer to all claims of said patent.

[*Official Gazette February 3, 1987.*]